US005831388A

United States Patent [19]

Genz et al.

[11] Patent Number: 5,831,388

[45] Date of Patent: Nov. 3, 1998

[54] RARE EARTH METAL HALIDE LAMP INCLUDING NIOBIUM

[75] Inventors: Andreas Genz; Joachim Dirks; Hans Werner Gölling; Clemens Barthelmes, all of Berlin, Germany

[73] Assignee: Patent-Truehand-Gesellschaftfuer Elektrische Gluelampen mbH, Germany

[21] Appl. No.: 681,046

[22] Filed: Jul. 22, 1996

[30] Foreign Application Priority Data

Aug. 23, 1995 [DE] Germany ..... 195 30 821.2
Dec. 22, 1995 [DE] Germany ..... 195 48 518.1

[51] Int. Cl.[6] ..... H01J 61/20

[52] U.S. Cl. ..... 313/641; 313/571

[58] Field of Search ..... 313/571, 637, 313/639, 640, 641, 642

[56] References Cited

U.S. PATENT DOCUMENTS

| | | | |
|---|---|---|---|
| 3,748,520 | 7/1973 | Silver | 313/639 |
| 4,074,166 | 2/1978 | Webb et al. | 313/642 |
| 4,290,097 | 9/1981 | Black et al. | 362/264 |
| 4,422,011 | 12/1983 | Bruninx-Poesen et al. | 313/642 |
| 4,672,267 | 6/1987 | Lapatarich et al. | 313/571 |
| 5,220,244 | 6/1993 | Maseki et al. | 313/640 |
| 5,264,760 | 11/1993 | Genz et al. | 313/641 |

FOREIGN PATENT DOCUMENTS

| | | | |
|---|---|---|---|
| 9423441 | 3/1993 | WIPO | H01J 61/12 |

*Primary Examiner*—Sandra L. O'Shea
*Assistant Examiner*—Michael Day
*Attorney, Agent, or Firm*—William H. McNeill

[57] ABSTRACT

A projection lamp includes a metal halide discharge lamp (1) with a light-transparent discharge vessel (2) in which two electrodes (3) stand opposite one another, which are joined with current leads (5) led to the outside, whereby the discharge vessel contains an ionizable filling including mercury, at least one noble gas, at least one halogen, one rare-earth metal (RE) as well as another metal, niobium, for the formation of metal halides. The addition of metallic niobium provides the lamp with good color reproduction and good arc stability.

10 Claims, 1 Drawing Sheet

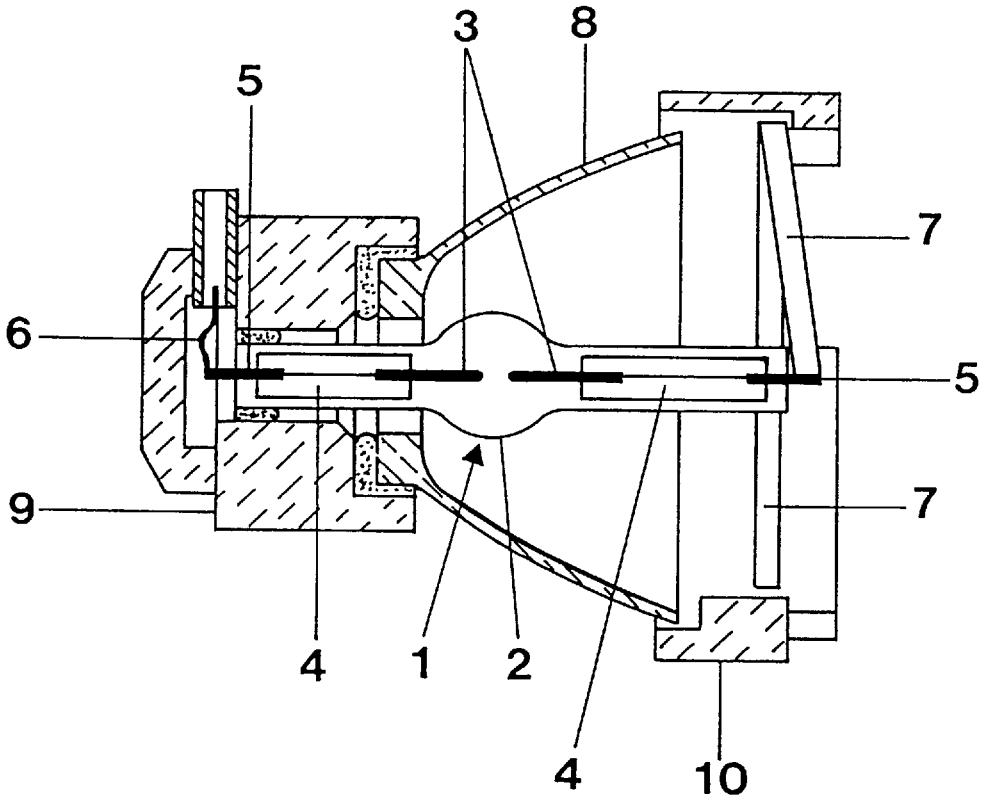
3
8
5
7
6
5
9
7
4
1
2
4
10

RARE EARTH METAL HALIDE LAMP INCLUDING NIOBIUM

TECHNICAL FIELD

The invention relates to metal halide discharge lamps and more particularly to such lamps for projection purposes. The lamps have a light-transparent discharge vessel in which two electrodes stand opposite one another, which are joined with current leads led to the outside, whereby the discharge vessel contains an ionizable filling comprised of mercury, at least one inert gas, at least one halogen, one rare-earth metal (RE) as well as another metal for the formation of metal halides.

BACKGROUND ART

Metal halide discharge lamps of this type are predominantly incorporated in optical reflectors or other optical imaging systems. Their field of application is, for example, the projection field or fiber-optic waveguide technology, etc., for overhead, slide, and movie projection as well as particularly for video projection or for endoscopy and boroscopy. For good imaging results, very short arcs (typical arc lengths of a few mm in all cases) and maximum luminences (on average more than approximately 30 kcd/cm$^2$) with color temperatures of more than 4500° K. and good color reproduction are necessary. Typical power values lie in the range between 100 W and 600 W. In addition, the time constancy of the site of the arc discharge within the lamp vessel achieves a special importance. In the case of an unstable arc, the discharge arc migrates stochastically from the focus of the lamp reflector and thus adversely affects the quality of the optical image.

Such a lamp is disclosed in WO 94/23441 for specific arc powers between 60 and 140 W per mm of arc length with a filling, which contains in addition to mercury (Hg) and an inert gas, additional halogen compounds of the elements cesium (Cs), dysprosium (Dy) and tantalum (Ta). It is a disadvantage that with arc powers higher than those given, increasing instability of the arc occurs.

DISCLOSURE OF THE INVENTION

It is, therefore, an object of the invention to obviate the disadvantages of the prior art.

It is another object of the invention to enhance the operation of arc discharge projection lamps.

The invention takes on the task of eliminating the named disadvantage and creating a metal halide discharge lamp, which has a color temperature of more than 4500° K.—with good color reproduction—as well as small arc instability, even with very high specific arc powers.

This task is resolved according to on aspect of the invention, by the provision of a metal halide discharge lamp for projection purposes which lamp has a light-transparent discharge vessel in which two electrodes stand opposite one another, which are joined with current leads led to the outside, and whereby the discharge vessel contains an ionizable filling comprised of mercury, at least one inert gas, at least one halogen, one rare-earth metal (RE) as well as another metal for the formation of metal halides, and where the other metal is niobium (Nb).

BRIEF DESCRIPTION OF THE DRAWING

The single FIGURE is schematic cross-sectional view of a lamp of the invention with a reflector.

BEST MODE FOR CARRYING OUT THE INVENTION

As measurements have shown, the task formulated above can also be resolved with a filling, which—in contrast to the cited state of the art—dispenses with Cs as a filling component. As a surprising result of the measurements, the instability of the arc—even without Cs and even with specific arc powers of up to 200 W per mm of arc length is still very small due to the addition of niobium (Nb) instead of Ta. A higher luminous power is obtained due to the omission of Cs.

According to the present state of knowledge, Nb acts directly on the arc projection in the electrode region. Without considering determinations of a theoretical nature, it proceeds from this that Nb forms a mixed phase with the electrode material, which contributes to arc stability.

The filling of the discharge lamp of the metal halide discharge lamp of the invention comprises the following filling components according to the first solution: Nb, a rare-earth metal (RE), preferably Dy, Hg, an inert gas and one or more halogens, preferably iodine (I) and/or bromine (Br) for the formation of the metal halides. Where iodine and bromine are used together they are preferably in the molar ratio of iodine to bromine in the range between 0.2 and 2 as halogens for the halide compounds.

Of course, Dy may also be replaced either completely or partially by another element of the rare earths with comparable properties in the gas discharge, e.g. by holmium (Ho).

The typical filling quantity per cm$^3$ of volume of the discharge vessel lies in the range between 0.3 $\mu$mole and 3 $\mu$moles for the rare-earth metal (RE), especially for Dy, and it lies in the range between 0.3 $\mu$mole and 3 $\mu$moles, preferably in the region between 1 $\mu$mole and 1.5 $\mu$mole for Nb. The filling pressure of the inert gas serving as the ignition gas, for example, argon (Ar) or xenon (Xe), typically lies in the region between 20 kPa and 60 kPa. The filling quantity of mercury serves for adjusting the desired arc-drop voltage of the lamp. It typically lies in the region between 5 mg and 15 mg per mm of arc length for arc-drop voltages between 30 V and 50 V.

In a second solution, the discharge vessel also contains up to approximately 3 $\mu$moles Cs per cm$^3$ of vessel volume. Preferably, the filling quantity of Cs lies in the range between 0.5 $\mu$mole and 2.5 $\mu$moles per cm$^3$ of vessel volume.

This filling system is particularly suitable for the highest requirements for arc stability and service life of the lamp, as well as also particularly for specific power densities of approximately 200 W and more per mm of arc length. Another degree of freedom for lamp design is now achieved by the Cs addition. This degree of freedom can be utilized, for example, for an optimizing of electrode geometry relative to a higher service life. The disadvantage, of course, is that luminous power decreases with increasing fraction of Cs. In the individual case, there is thus a suitable compromise for the concrete value of the Cs fraction.

Advantageously, the lamp is combined into one structural unit with a reflector, as described in DE Patent 2,840,031. The lamp is mounted approximately axially in the reflector. The reflector is coated, e.g., dichroically.

Quartz glass or a transparent ceramic material, for example, $Al_2O_3$ is suitable as a material for the lightbulb. A two-sided sealed discharge vessel is particularly suitable for the lamp.

Two electrodes stand opposite one another inside the discharge vessel. The electrodes are each joined with a current lead, and these are led to the outside in a gas-tight manner.

Typical values for the specific arc power lie in the range between approximately 100 W and 200 W or more per mm of arc length, particularly in the region between approximately 150 W and 200 W per mm of arc length. Average luminances of typically more than 45 kcd/cm$^2$ are thus obtained.

The invention is explained in more detail below on the basis of two filling examples.

The longitudinal section of a metal halide discharge lamp 1 with a power of 270 W joined rigidly with a reflector is schematically shown in the FIGURE. Discharge vessel 2 comprised of quartz glass possesses an essentially bulb-shaped configuration, and has a neck on each of the two diametrically opposed ends, into which pin-shaped tungsten electrodes 3 are sealed by means of sealing foils 4 of molybdenum. The ends of sealing foils 4 turned away from the discharge space are welded with current leads 5, which are joined in turn with electrical connections 6, 7 of the reflector base system. The reflector base system comprises—in addition to electrical connections 6, 7—essentially reflector 8 and a two-part ceramic base 9, 10. For a detailed explanation of the reflector base system, refer to DE Patent 2,840,031.

The inside volume of discharge vessel 2 enclosing an ionizable filling amounts to approximately 0.33 cm$^3$. Electrodes 3 that are axially opposed stand at a distance of 1.6 mm from one another.

In a first example, the filling comprises the other filling components listed in Table 1 below in the quantities given there, along with 12 mg of Hg and 45 kPa Ar as the base gas. The molar quantities of several filling components calculated relative to volume are listed in the following Table 2. The specific arc power and the arc-drop voltage amount to approximately 167 W per mm of arc length and approximately 35 V. Table 3 shows the light-technical values of the lamp produced with this filling.

TABLE 1

Quantities of the components of the first filling example of the lamp

| | |
|---|---|
| Nb | 0.04 mg |
| Dy | 0.08 mg |
| Hg | 12 mg |
| $HgBr_2$ | 0.7 mg |
| $HgI_2$ | 0.68 mg |
| Ar | 45 kPa |

TABLE 2

Molar quantities of several filling components of Table 1 relative to volume

| | |
|---|---|
| Nb | 1.30 $\mu$mole/cm$^3$ |
| Dy | 1.49 $\mu$mole/cm$^3$ |
| I | 4.51 $\mu$mole/cm$^3$ |
| Br | 6.47 $\mu$mole/cm$^3$ |

TABLE 3

Light-technical values obtained with the filling of Table 1

| | |
|---|---|
| Light current | 17 klm |
| Luminous power | 63 lm/W |
| Average luminance | 50 kcd/cm$^2$ |
| Color temperature | 5000K |
| $R_a$ | 60 |
| Service life | >500 h |

In a second example, the filling comprises the filling components listed in Table 4 below in the quantities given there, along with 12 mg of Hg and 45 kPa Ar as the basic gas. The molar quantities of several filling components calculated relative to volume are listed in Table 5 below. The specific arc power and the arc-drop voltage amount to approximately 167 W per mm of arc length and approximately 35 V. Table 6 shows the light-technical values of the lamp obtained with this filling.

TABLE 4

Quantity of components of the second filling example of the lamp.

| | |
|---|---|
| Nb | 0.04 mg |
| Dy | 0.08 mg |
| CsI | 0.17 mg |
| Hg | 12 mg |
| $HgBr_2$ | 0.7 mg |
| $HgI_2$ | 0.53 mg |
| Ar | 45 kPa |

TABLE 5

Molar quantities of several filling components of Table 4 relative to volume

| | |
|---|---|
| Nb | 1.30 $\mu$mole/cm$^3$ |
| Dy | 1.49 $\mu$mole/cm$^3$ |
| Cs | 1.98 $\mu$mole/cm$^3$ |
| I | 5.51 $\mu$mole/cm$^3$ |
| Br | 6.47 $\mu$mole/cm$^3$ |

TABLE 6

Light-technical values obtained with the filling of Table 4

| | |
|---|---|
| Light current | 16 klm |
| Luminous power | 60 lm/W |
| Average luminance | 50 kcd/cm$^2$ |
| Color temperature | 5000K |
| $R_a$ | 60 |
| Service life | >500 h |

What is claimed is:

1. A projection lamp comprising:

a metal halide discharge lamp with a light-transparent discharge vessel in which two electrodes stand opposite one another, which are joined with current leads led to the outside, whereby the discharge vessel contains an ionizable filling comprised of mercury, at least one inert gas, at least one halogen, one rare-earth metal (RE) as well as another metal for the formation of metal halides, said another metal being niobium.

2. The projection lamp of claim 1, further characterized in that the filling quantity of Nb lies in the range between 0.3 $\mu$mole and 3 $\mu$mole per cm$^3$ of vessel volume.

3. The projection lamp of claim 2, further characterized in that the filling quantity of Nb preferably lies in the range between 1.0 $\mu$mole and 1.5 $\mu$mole per cm$^3$ of vessel volume.

4. The projection lamp of claim 1, further characterized in that the filling contains dysprosium (Dy) as the rare-earth metal, whereby the filling quantity of Dy lies in the range between 0.3 $\mu$mole and 3 $\mu$moles per cm$^3$ of vessel volume.

5. The projection lamp of claim 1, further characterized in that the discharge vessel contains iodine (I) and bromine (Br) in a molar ratio of iodine to bromine in the range between 0.2 and 2 as halogens for the halide compounds.

6. A projection lamp comprising:

a metal halide discharge lamp with a light-transparent discharge vessel in which two electrodes stand opposite one another, which are combined with current leads led to the outside, said discharge vessel containing an ionizable filling, comprised of mercury (Hg), at least one inert gas, at least one halogen, cesium (Cs) and a rare-earth metal (RE) as well as another metal for forming metal halides, said another metal being niobium.

7. The projection lamp of claim 6, further characterized in that the filling quantity of Nb lies in the range between 0.3 $\mu$mole and 3 $\mu$moles per $cm^3$ of vessel volume.

8. The projection lamp of claim 6, further characterized in that the filling quantity of Cs per $cm^3$ of vessel volume lies in the following range:

$0\ \mu\text{mole} < Cs \leqq 3\ \mu\text{moles}$.

9. The projection lamp of claim 8, further characterized in that the filling quantity of Cs per $cm^3$ of vessel volume preferably lies in the following range:

$0.5\ \mu\text{mole} < Cs \leqq 2.5\ \mu\text{moles}$.

10. The projection lamp of claim 6, further characterized in that the filling contains dysprosium (Dy) as the rare-earth metal, whereby the filling quantity of Dy lies in the range between 0.3 $\mu$mole and 3 $\mu$moles per $cm^3$ of vessel volume.

* * * * *